US005101937A

United States Patent [19]

Burrell et al.

[11] Patent Number: 5,101,937

[45] Date of Patent: Apr. 7, 1992

[54] SELF CENTERING ELEVATOR CABLE SAFETY BRAKE

[76] Inventors: Michael P. Burrell, 91 Richland Crescent, Etobicoke, Ontario; Ryszard J. Ambrozy, 2415 Jane Street Apt. 606, Downsview, Ontario, M3M 1A9, both of Canada

[21] Appl. No.: 709,731

[22] Filed: Jun. 3, 1991

[51] Int. Cl.[5] ..... B66B 5/02

[52] U.S. Cl. ..... 187/74; 187/73; 187/77; 188/65.1

[58] Field of Search ..... 187/20, 73, 74, 77, 187/89, 90; 188/65.1, 65.2, 65.3, 65.4, 65.5

[56] References Cited

U.S. PATENT DOCUMENTS

| | | | |
|---|---|---|---|
| 397,912 | 2/1889 | Hanford | 187/89 |
| 615,080 | 11/1898 | Lurye . | |
| 1,738,214 | 12/1929 | Thurston | 188/65.1 X |
| 1,738,215 | 12/1929 | Thurston et al. | 188/65.1 X |
| 2,244,893 | 6/1941 | Panter | 187/73 X |
| 3,250,348 | 5/1966 | Moyer | 188/188 |
| 3,934,682 | 1/1976 | Hedstrom | 187/89 X |
| 4,029,177 | 6/1977 | Fiss | 187/89 |
| 4,311,220 | 1/1982 | Maurer | 188/170 |
| 4,556,155 | 12/1985 | Koppensteiner | 187/89 X |
| 4,875,558 | 10/1989 | Berkhan et al. | 188/171 |
| 4,923,055 | 5/1990 | Holland | 187/109 |
| 4,977,982 | 12/1990 | Simsbury et al. | 187/89 |

FOREIGN PATENT DOCUMENTS 186988 10/1922 United Kingdom .

OTHER PUBLICATIONS

1 Page ad by Bode ® Elevator Components for a Rope Brake from Elevator World (Jan. 1991 issue).
Pages 54–56 of Elevator World (Dec. 1990 issue).

*Primary Examiner*—Robert P. Olszewski
*Assistant Examiner*—Dean A. Reichard
*Attorney, Agent, or Firm*—Bereskin & Parr

[57] ABSTRACT

An elevator cable safety brake is disclosed. The brake includes a first housing which is slidably mounted in a second housing. The first housing has an opening through which the elevator cables can pass. On one side of the elevator cables is located a first brake pad which is carried by the first housing. On the other side of the opening is located a second brake pad which is generally wedge shaped. The second brake pad is carried on a sled which is slidably housed within the first housing. The second brake pad may be moved between a free running position and a braking position. The wedge shaped second brake pad may be selectively released under certain trip conditions from the free running position to the braking position. Such conditions include the unintended overspeed operation of the elevator, a power failure, or the elevator commencing movement before the elevator doors are fully closed. A governor trips a trip lever effecting the release of the second wedge shaped brake pad. The slidable interaction between the sled and the first housing and the second housing enables the brake device to be self centering around the cables during the braking action. In an alternate embodiment the safety brake works in both the up and down directions.

20 Claims, 13 Drawing Sheets

SELF CENTERING ELEVATOR CABLE SAFETY BRAKE

FIELD OF THE INVENTION

The present invention relates generally to the field of elevator safety brakes and in particular elevator safety brakes which are compact, may be retrofit onto existing elevator cable installations or included with new installations, and which act directly on elevator cables.

A typical elevator installation includes a passenger car which is supported by a plurality of ropes, usually wire ropes, which are attached to the elevator car at one end, pass upwardly over a drive sheave at the top of an elevator shaft and then down and are connected to a counterweight at the other end. Elevator car safety devices have been known and used extensively in the past to prevent elevator cars, in the event of a rope breakage or other mishap, from falling uncontrolled down the elevator shaft.

Typically, such elevator cable safety devices are activated by a secondary trip system which includes a follower line attached to the elevator and which has pulleys at the bottom of the elevator shaft and at the top of the elevator shaft to allow the follower line, in the form of an endless loop, to follow the elevator up and down. In the event of an unsafe circumstance arising, a trip mechanism clamps the endless loop, slowing it relative to the elevator car and in turn causing an elevator car safety brake to be applied. An example of such a system is disclosed in U.S. Pat. No. 4,923,055 granted on May 8, 1990.

While such systems have certain advantages, there are also numerous disadvantages. For example, such a system has a safety brake at the bottom of the elevator car which will only operate when an overspeed occurs with the car falling down the elevator shaft. Other unsafe conditions can occur which this prior safety device does not recognize. In the event the car is lightly loaded with only a few people in it, the counterweight can be heavier than combined weight of the car and people. Thus, if a failure occurs, such as a broken shaft, the counterweight can fall unrestrained, in turn pulling the car up into the top of the elevator shaft where it may crash. In other circumstances, such as a brake failure or a control system failure, the car can move in the elevator shaft while the doors are open.

It would be preferable to have a elevator device that could operate to stop the elevator car in the event of each or all of these types of failures.

Other devices have been proposed, for example U.S. Pat. No. 2,244,893 which discloses a braking device to be applied directly to the cables of the elevator car. However, this device requires a special hinged mounting of the drive sheave on a special platform to function. This is an expensive and difficult proposition, and not usually suited to being retrofit onto existing installations.

Still further, devices have been proposed for example U.S. Pat. Nos. 4,923,055 and 4,977,982 which both disclose devices that attempt to solve these problems by applying a brake to the elevator drive sheave. However, in certain conditions it is possible for the cables to slide over the sheaves. Therefore even if the drive sheave is stopped by the taught brakes, the car may still continue to travel and the unsafe condition will consequently still exist.

What is required therefore is an elevator safety braking device which can be applied directly to the elevator cables and which does not require modification of the basic elevator structure so that it can be retrofit into existing installations. What is also required is an elevator brake safety device which is safe and reliable and does not rely on any exterior sources of power in order to function. It is preferable for the device to be operable mechanically so that the safety device will work, even in the event of a power failure or the like.

It is also preferable if the device can operate under different unsafe conditions such as during a power failure, in case there is an overspeed condition, in the event of a brake failure, in the event of the elevator moving with its doors open, or in the event that the elevator motor becomes unstable.

BRIEF SUMMARY OF THE INVENTION

According to the present invention there is disclosed a safety braking device for use on elevator cables, said device comprising:

a first housing slidably mounted in a second housing and having an opening through which said elevator cables can pass a first brake pad carried by said first housing on one side of said opening a second generally wedge shaped brake pad mounted in said first housing generally opposite said first brake pad on the opposite side of said opening and being moveable between a free-running position and a braking position; and means for releasing said second brake pad from said free-running position;

in use said first and second brake pads frictionally engaging and stopping said elevator cables upon said second brake pad being released by said release means, said first housing sliding within said second housing to keep said brake pads aligned around said cables during said stopping of said cables.

LIST OF FIGURES

Reference will now be made by way of example only to the following figures which illustrate preferred embodiments of the invention and in which FIG. 1A is a general view showing the placement of an elevator safety device according to the present invention;

Figure 1A:
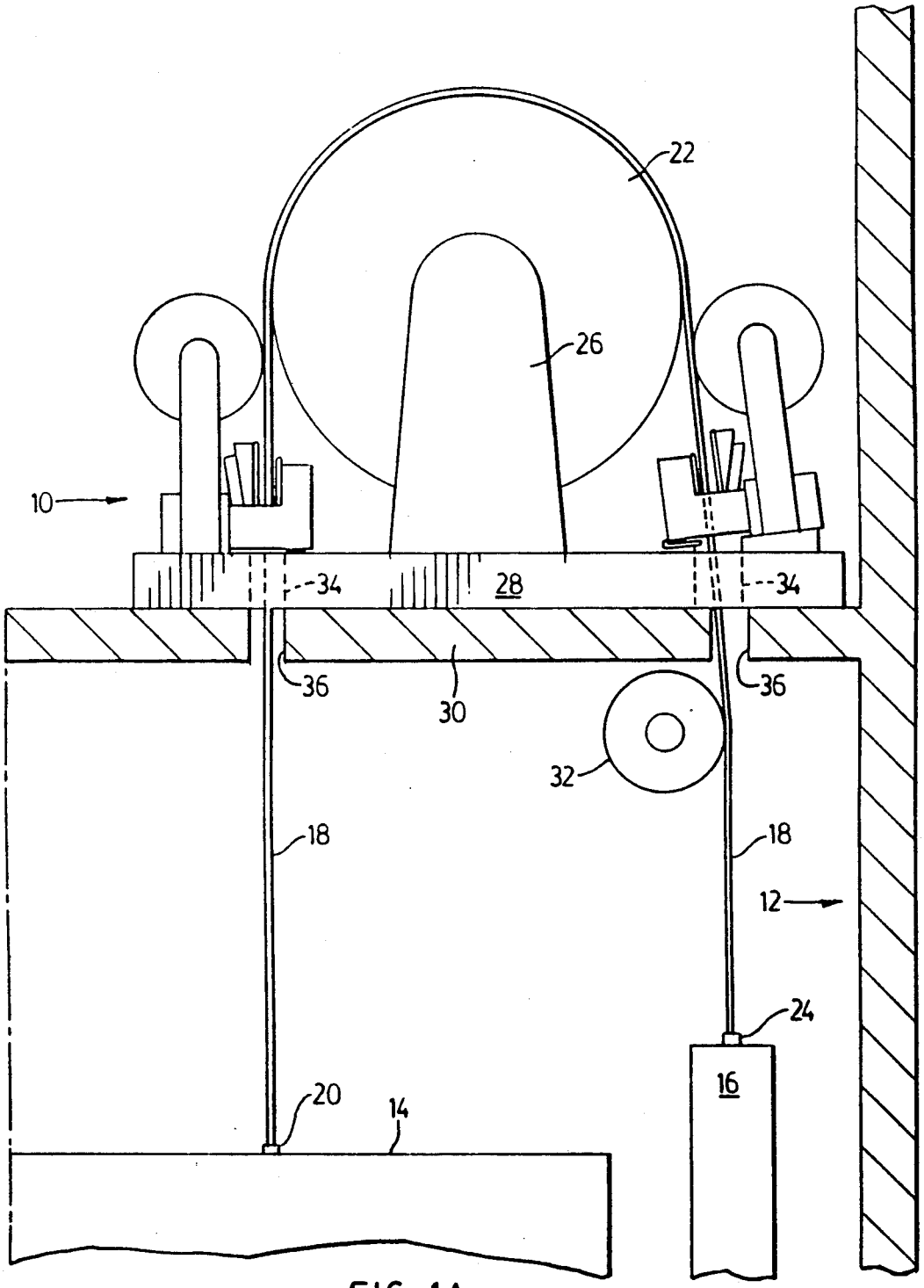
FIG. 1B is the safety device of FIG. 1 in greater detail.

FIG. 1 shows the general location of an elevator safety device 10 according to the present invention. An elevator shaft 12 houses an elevator car 14 and a counter weight 16. Elevator cables 18 are attached to the elevator car at 20 runs up over a traction sheave 22 and down to the counter weight 16 where it is attached at point 24. The traction sheave 22 is supported on an arm 26 which extends upwardly from a machine base 28. Machine base 28 rests on a machine room floor 30. An idler may also be used, shown as 32. It will be appreciated by those skilled in the art that the traction sheave 22 will be driven by a motor (not shown) during normal operation. The elevator cable 18 passes through respective openings 34 in the base of the machine and 36 in the machine room floor. From the foregoing it can be seen how the elevator safety device 10 is intended to be retrofit into a typical elevator installation.

Figure 1B:
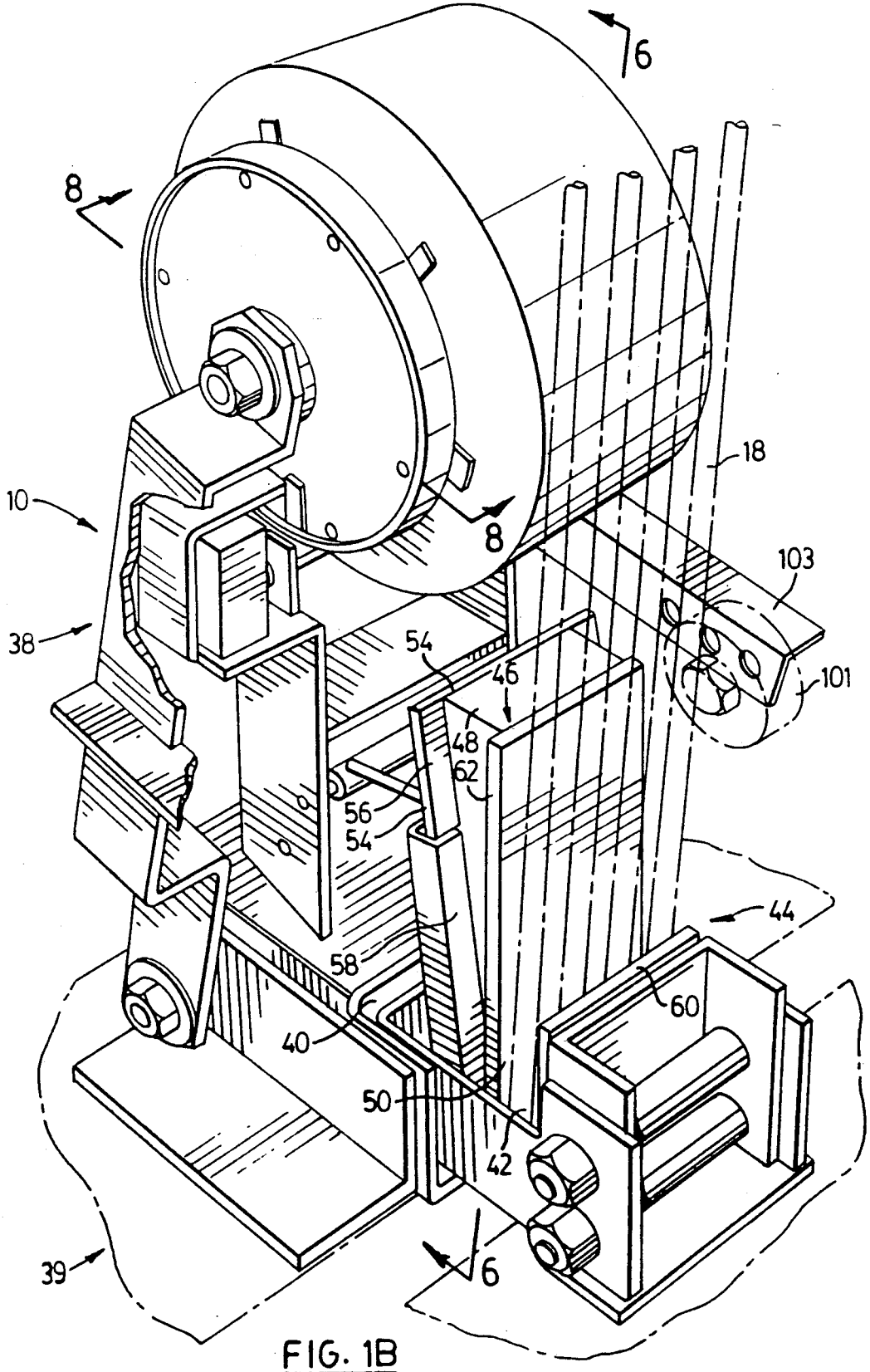

FIG. 1B shows the basic elements of the safety device 10 which according to the present invention has two main interacting components, namely, a trip mechanism, denoted generally as 38, and a brake mechanism denoted generally as 39. The brake mechanism 39 includes a first housing 40 which has an opening 42 through which elevator cables 18 (shown in ghost outline) may pass. A first brake block 44 is secured to the first housing 40 adjacent one side of the opening 42. A second brake block 46 is located on the opposite side of the opening 42 from the first brake block 44. The second brake block 46 is generally wedge shaped and in the preferred embodiment of FIG. 1B has a wider top 48 which narrows to a point 50 at the bottom end. The second brake block 46 is carried on a sled 52 (shown in FIG. 7) which moves within the first housing 40. As can be seen, the second brake block 46 has a rear plate 54 which has outwardly extending lips 56. These fit inside a track 58 on the sled 52 to allow the second brake block 46 to slide up and down. Both first brake block 44 and second brake block 46 have opposed frictional contact brake pad surfaces 60 and 62 respectively. As will be appreciated by those skilled in the art, the preferred braking material is similar to that used in other brake systems, such as in the automotive industry.

The wedge shape of the second brake block 46, in combination with the incline of track 58, cooperate to move the braking surface 62 laterally across the opening 42 and towards the first brake block surface 60. Eventually, as the second brake block 46 moves downwardly, and braking surface 62 moves laterally, the elevator cables 18 will be contacted and the resulting force on 52 slides housing 40 laterally forcing surface 60 into contact with elevator cables 18 on the opposite side of cables 18 from braking surface 62.

Figure 7:
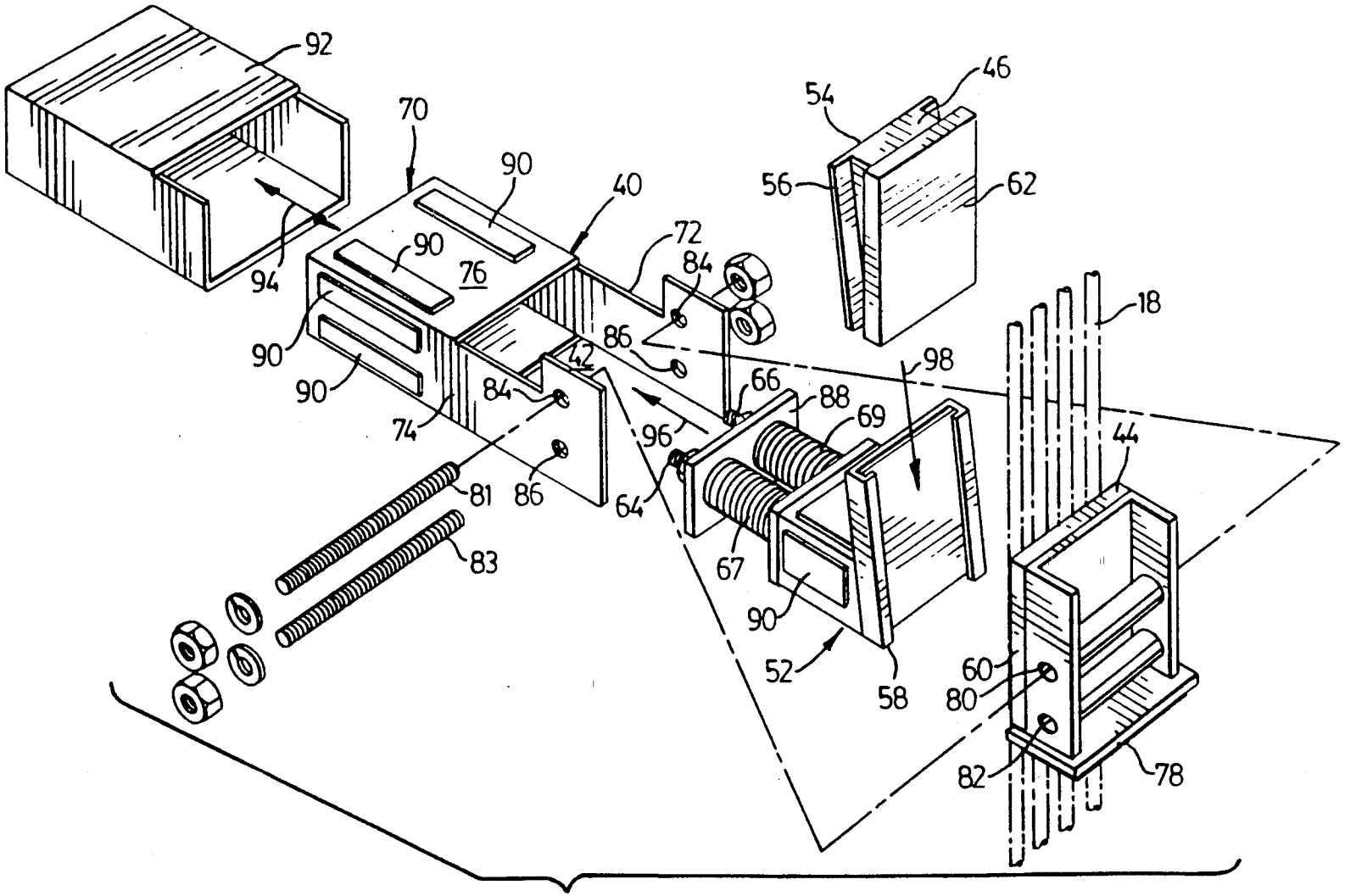
FIG. 7 is an exploded view of the components of a portion of the elevator safety device shown in FIG. 2.

In the preferred embodiment the sled 52 includes a pair of rearwardly extending posts 64 and 66 which are best illustrated in FIG. 7. A biaser, which in the preferred embodiment comprises a plurality of disc spring washers, shown as 67 and 69, are placed on the posts 64 and 66 as shown. Also shown is the first housing 40 within which the sled 52 moves. The first housing 40 is provided with a rear wall 70. In the preferred embodiment as illustrated in the drawings, the biaser (springs 67 and 69) acts between the rear wall 70 of the first housing 40 and the sled 52. Thus, as the second brake block 46 is displaced downwardly, the sled 52 is displaced laterally against the springs 67, 69 which in turn gradually increase the urging force of the brake surface 62 onto the elevator cables 18 until eventually the cables 18 are clamped so tightly between surfaces 60, 62 that they are stopped.

Also shown in FIG. 7 are a number of other components of the braking mechanism 39. Again, the elevator wire ropes or cables are shown in ghost outline as 18. The first and second brakes 44 and 46 are shown. It can now be appreciated that the opening 42 is formed between two flanges 72 and 74 respectively at the sides, a rear housing portion 76 at the second brake block 46 end, and an end member 78 which spans the space between the two flanges 72 and 74. The end member 78 carries the first brake 44 on an inside surface, and has a pair of holes 80 and 82 for bolts 81 and 83 respectively. The holes 80 and 82 match up with holes 84 and 86 in the flanges 74 and 72 respectively and allow the end member 78 to be bolted in between the end flanges 72, 74. In this manner, the brake mechanism 39 can easily be installed around existing elevator cables without the need to undo the elevator cables from the car or the counterweight. It will be appreciated by those skilled in the art that there may be other configurations which enable the device to be easily installed around cables 18. However, the essential requirements of any such configurations are that the device be able to be strong enough to brake the cables 18 on the one hand, yet includes an opening such as 42 through which the elevator cables 18 may pass.

Also shown is a plate 88 which spans the posts 64 and 66. This plate 88 interacts with the rear wall 70 of the first housing 40 and provides a firm surface against which the disc spring washers 69 and 67 can act against.

Also shown are low friction strips 90 which are for the purpose of smooth relatively frictionless sliding of the sled 52 within the first housing 40. It will be noted that there are additionally some low friction strips 90 located on the exterior of the first housing 40. Satisfactory results have been achieved when the strips are made from TEFLON (trade-mark of Du Pont). The first housing 40 is located within a second housing or mounting member 92. Mounting member 92 is preferably fixed to the floor or the like and is stationary. The first housing 40 fits within the mounting member 92 and is capable of sliding axially in the direction of arrow 94 within the member 92.

It can now be appreciated how the brake mechanism 39 of the present invention functions. At one end is the first brake block 44 which is capable of sliding axially with resect to the mounting member 92 since it is fixed to first housing 40 which is slidably housed within the mounting member 92. To assist the easy sliding, a mounting plate 93 is provided under end 78 which also has a low friction strip 90 (shown in FIG. 2). On the opposite side of the brake cables 18 is the second brake block 46 which is carried by the sled 52 which in turn is capable of moving axially within the first housing 40 in the direction of arrow 96. Additionally, the second brake block 46 is capable of moving vertically in the direction of arrow 98. By reason of the wedge shape of second brake block 46, vertical movement has the effect of moving the brake pad 62 towards brake pad 60 causing the cables 18 to be engaged. Again, by reason of the wedge shape of second brake block 46, the sled 52 will be displaced rearwardly against the disc spring washers 69, 67 which in turn will urge the second brake block 46 more firmly against the cables 18. In turn the cables 18 will drag second brake block 46 in a downwardly direction again increasing the displacement and compression of the disc spring washers 67, 69. This increases the amount of braking pressure being applied to the cables 18 thereby eventually causing the cables 18 to be stopped. Throughout this braking procedure, the first housing 40 is free to slide axially and thereby maintain its centered alignment around the elevator cables 18.

Figure 2:
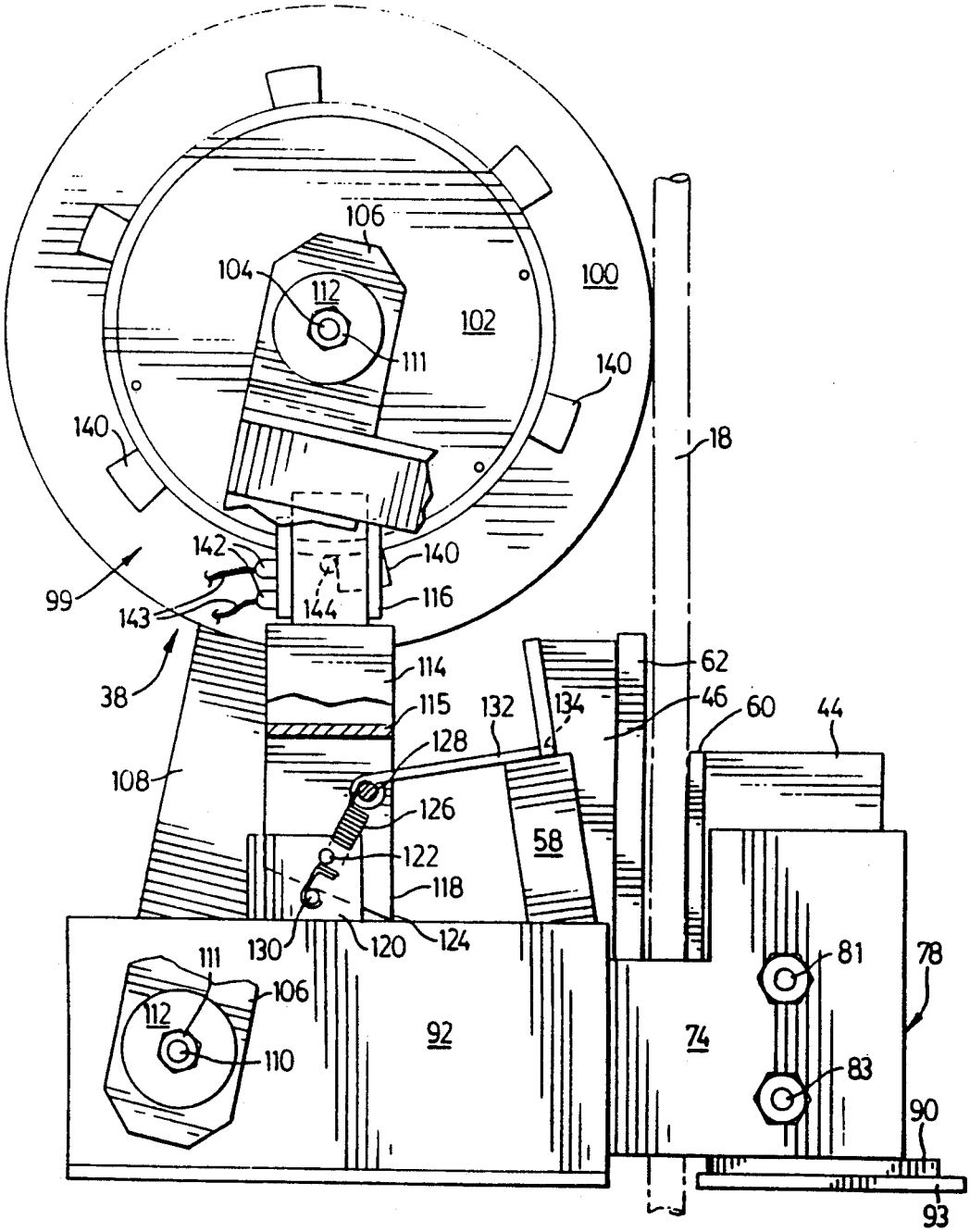
FIG. 2 is a side view of an elevator safety device in normal position according to one aspect of the present invention.

Turning now to the trip mechanism, denoted as 38, a side view of the main components can be seen in FIG. 2. FIG. 2 shows brake cables 18 again in ghost outline. Also shown are bolts 81 and 83 and flange 74. The first brake block 44 and the second brake block 46 are also visible. The trip mechanism 38 is carried on the mounting member 92.

The trip mechanism 38 comprises a governor denoted generally at 99 which includes a rubber wheel 100 which rides on the brake cables 18. It will be appreciated that as the cables 18 move past the trip mechanism 38 and in particular governor 99, the rubber wheel 100 will be rotated. To ensure continuous contact between the rubber wheel 100 and the cables 18 a counterweight 101 may be placed at an appropriate length along a counterbalance arm 103 (see FIG. 1B). The rubber wheel 100 is mounted on a hub 102 which in turn is mounted on an axle 104. The axle 104 is carried by a pair of arms 106 and 108. In FIG. 2 the arm 106 is broken away for ease of understanding. The arms 106 and 108 are pivotally bolted to the housing 92 at 110, and washers and nuts 111 and 112 are shown at the upper and lower connections.

Also shown is a trip lever 114 which has an activation end 116 and a lower pivot end 118. The lower pivot end 118 is pivotally attached to a flange 120 by means of a hinge pin 122. The lower end 118 is angled to a point at 124 which, in the normal position as shown in FIG. 2, rests on the top of the mounting member or second housing 92 as shown. Also shown in the broken away section of FIG. 2 is a spring 126 which extends between a post 128 on the trip lever 114 and a post 130 on the flange 120.

Extending from the post 128 is a release lever 132. The release lever extends outwardly and into the rear of the second brake block 46 and into a hole shown as 134. It will be appreciated by those skilled in the art that a single release lever 132 may be adequate, although in the preferred embodiment a pair of opposed release levers 132 are used to maintain the horizontal alignment of the second brake block 46 within the track 58. This is shown more clearly in FIG. 6 and is discussed in more detail below.

In the embodiment of FIG. 2, the spring 126 is extended upon the trip lever 114 pivoting about point 122. As trip lever 114 rotates, the end point 124 is raised off of the mounting member 92. By the positioning of the posts 128 and 130, relative to hinge pin 122, the spring 126 encourages the trip lever 114 to become fully tripped in the event that it is overbalanced even a little bit.

Figure 3:
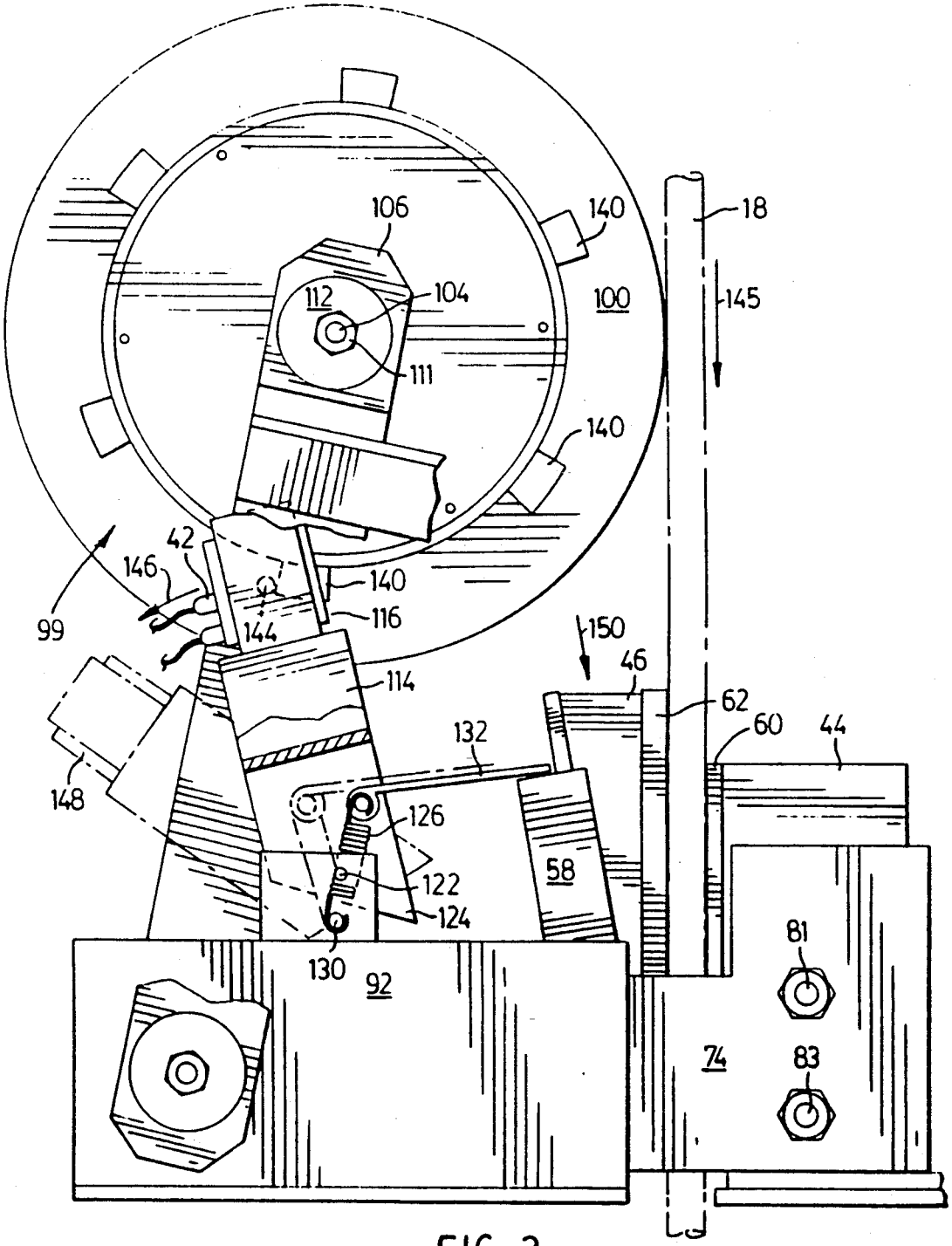
FIG. 3 is the safety device of FIG. 2 in a tripped position.

Turning now to the means for tripping the trip lever, or the trip mechanisms, it can be seen that extending outwardly from the hub 102 are fixed lugs 140. Also shown in side view are solenoid switches 142 with electrical leads 143. Solenoid switches 142 activate a plunger 144 which is shown in ghost outline at the activation end 116 of the trip lever 114. As shown in FIG. 2, when the solenoids 142 are not activated, the plunger 144 extends outwardly and can be contacted by a fixed lug 140. Turning to FIG. 3, it can be appreciated what effect contact between the plunger 144 and the fixed lug 140 may have. As the governor 99, and wheel 100 continues to rotate, by reason of the cables 18 moving in the direction of arrow 145 the fixed lug 140 will drive the plunger 144 to the left in FIG. 3, causing the trip mechanism 114 to pivot about pivot point 122 raising point 124 off of housing 92. This causes the upper end 116 to rotate in direction of arrow 146. As it begins to trip over, it is assisted by spring 126 to tip further, until it assumes a position shown in ghost outline as 148. As the trip lever 114 moves from the position shown in solid outline to the position shown in ghost outline 148 the release lever 132 is withdrawn out of the hole 134 until the second brake block 46 is fully released. This in turn allows the second brake block 46 to move in direction of arrow 150 which it will do by gravity. As the brake pad 62 comes into contact with the cable 18 the braking mechanism will begin to take effect as earlier described. Namely, the frictional contact between the cable 18 and the second brake block 46 will drive the second brake block 46 downwardly compressing the springs 69, 67 which in turn urge the second brake block 46 against the cables 18 and against the first brake surface 60. During this time of course the first housing 40 remains centered around the cables 18 by reason of the sliding pads 90 and the axial movement permitted between the first housing 40 and the second housing 92.

Figure 4:
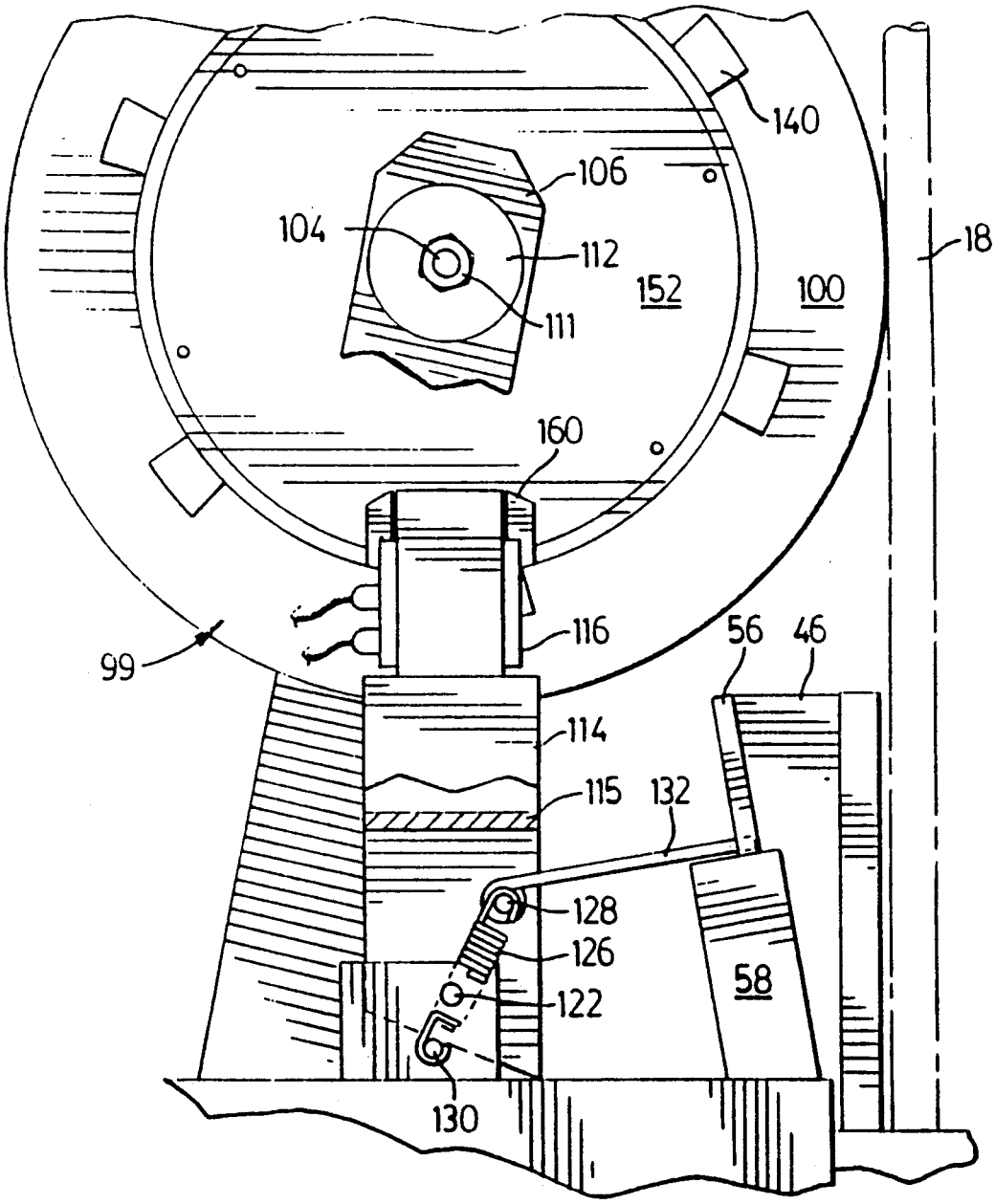
FIG. 4 is generally the same as FIG. 2, showing an over speed trip mechanism in normal position.

Turning to FIG. 4, a second trip mechanism is disclosed. The view of FIG. 4 is identical to the view of FIG. 3, with the exception that more of the first arm 106 is broken away. The governor 99 includes a cover plate 152 which rests on axle 104. In other words, while the hub 102 and the rubber wheel 100 are rotating, the cover plate 152 ordinarily is stationary. The cover plate 152 is formed with a notch 160 in its lower end. Into this notch 160 is fitted the upper activation end 116 of the trip lever 114. The purpose of this notch 160 will be explained below.

Figure 8:
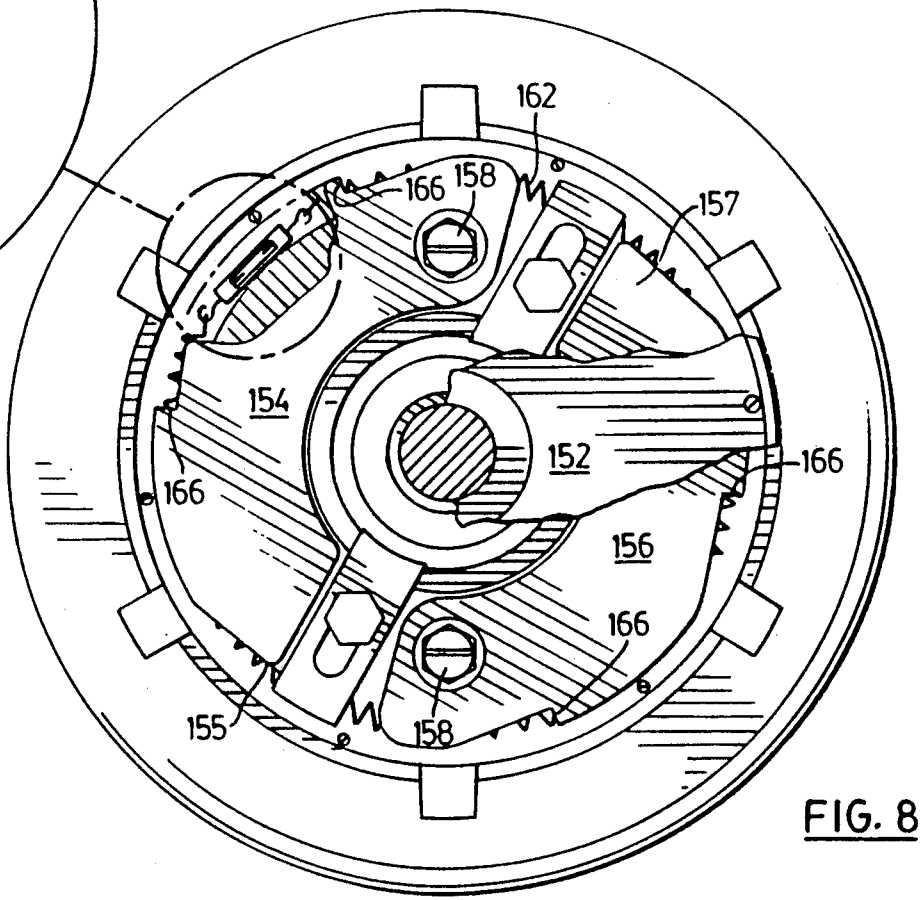
FIG. 8 is a view of a portion of FIG. 2, but with a plate removed and along lines 8—8 of FIG. 1B.
Figure 9:
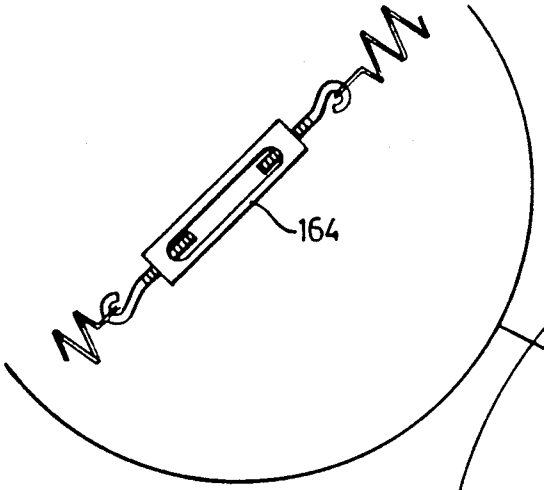
FIG. 9 is an enlarged side view of area 9 of FIG. 8.

Turning to FIG. 8, a view of the governor 99 with cover plate 152 broken away is shown. Underneath the cover plate 152 are located a pair of pivoting dogs 154, 156. Each dog is pivotally attached by means of a bolt 158. Around the exterior of the dogs 154, 156 is located a spring 162. The spring 162 may be made adjustable by means of a turn buckle, for example, shown in enlarged section in FIG. 9 as 164. The external surface of the dogs 154 and 156 contain a plurality of notches 166.

Figure 5:
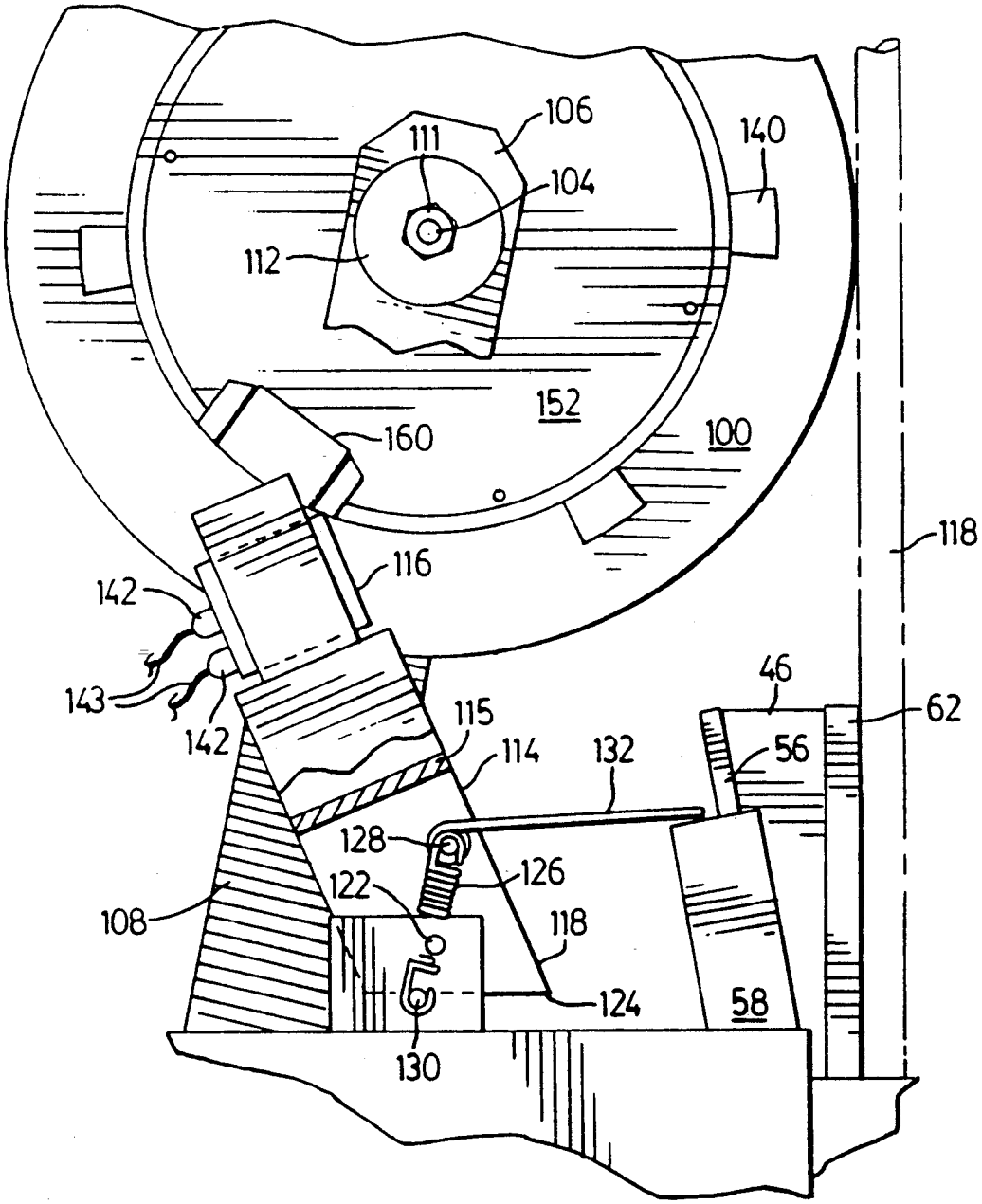
FIG. 5 is the device of FIG. 4, but in the tripped position.
Figure 10:
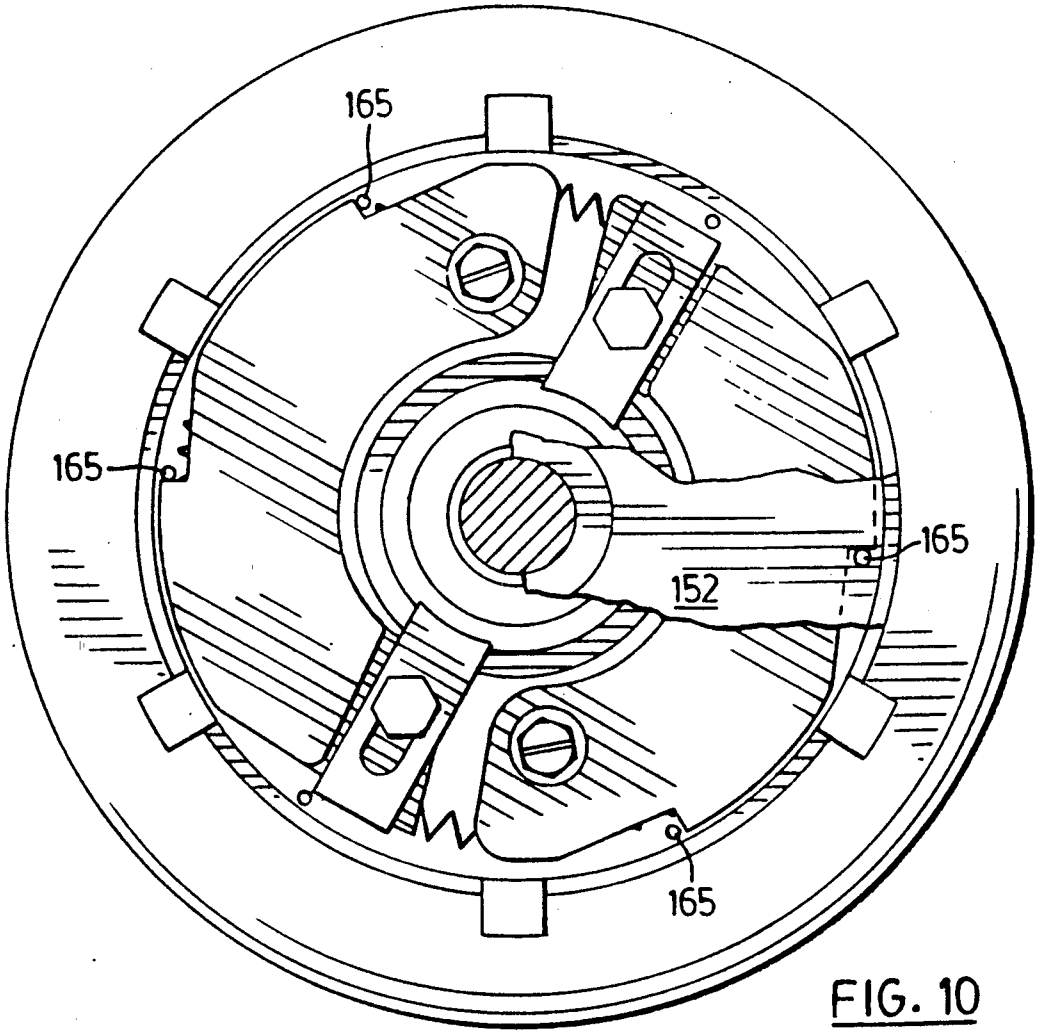
FIG. 10 is the device of FIG. 8, shown in the tripped position.

It can now be appreciated how the overspeed trip mechanism functions. As the speed of the governor 99 increases, free ends 155, 157 of the dogs will be urged outwardly by centrifical acceleration. This outwardly urging will be restrained to a certain extent by the spring 162 but will gradually increase as the speed of the governor 99 increases. Although the notches 166 pass by the upper end 116 of the trip lever 114 housed in the notch 160 of cover plate 152 during normal operation, in an over speed situation, the notches 166 will catch the cover plate lugs 165 (shown in FIG. 10) thus turning the cover plate 152 causing notch 160 to contact the trip lever 114 thereby causing the trip lever 114 to be tripped and releasing the second brake block 46 as previously described. The tripped configuration is shown in FIG. 5 with the notch 160 in the cover plate 152 displaced laterally and the trip lever 114 shown in a position where the release lever 132 is disengaged from the second brake block 46. FIG. 10 merely shows the internal configuration under cover plate 152 in an overspeed condition when the dogs 156 and 154 are extended outwardly to the trip position against lugs 165.

Figure 6:
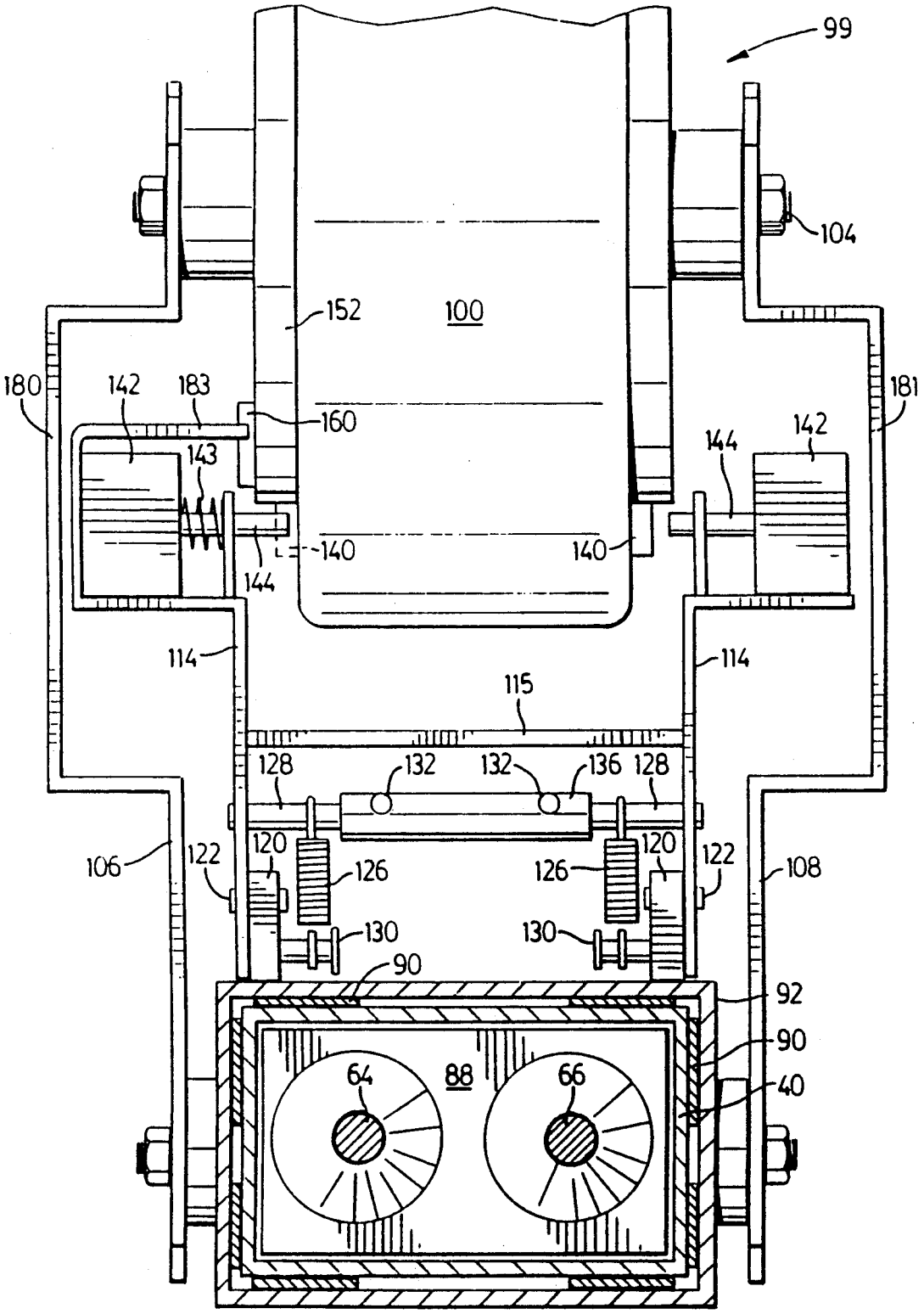
FIG. 6 is a sectional view along lines 6—6 of FIG. 1.

FIG. 6 is a sectional view from behind along the lines of 6—6 of FIG. 1B. Shown in FIG. 6 is the governor 99 on bolt or axle 104. Also shown are arms 106 and 108 which extend between the mounting member 92 and the axle 104. It can be seen in side view that there are jogs 180, 181 respectively in arms 106, 108 to accommodate the solenoids 142. It will also be appreciated that solenoids 142 are placed on either side of the wheel 100. Having two solenoids is preferred so that in the event of one solenoid failing, the mechanism will still function. Also shown is the plunger 144 which on the left hand side extends outwardly sufficient to engage the lug 140 whereas on the right hand side is shown in the retracted or energized position.

Also shown is the trip lever 114 upon which the solenoids 142 are mounted. On the left hand side of the trip lever 114 is shown an upper lip 183 which engages in notch 160 in the cover plate 152 of the governor. Also shown is a cross support plate 115 which connects the two arms 106, 108 of the trip lever 114.

The spring mount 130 is shown together with a pair of springs 126 and the pivot pin 128. The release lever 132 extends outwardly from a sleeve 136 which is carried by the pivot pin 128.

Figure 11:
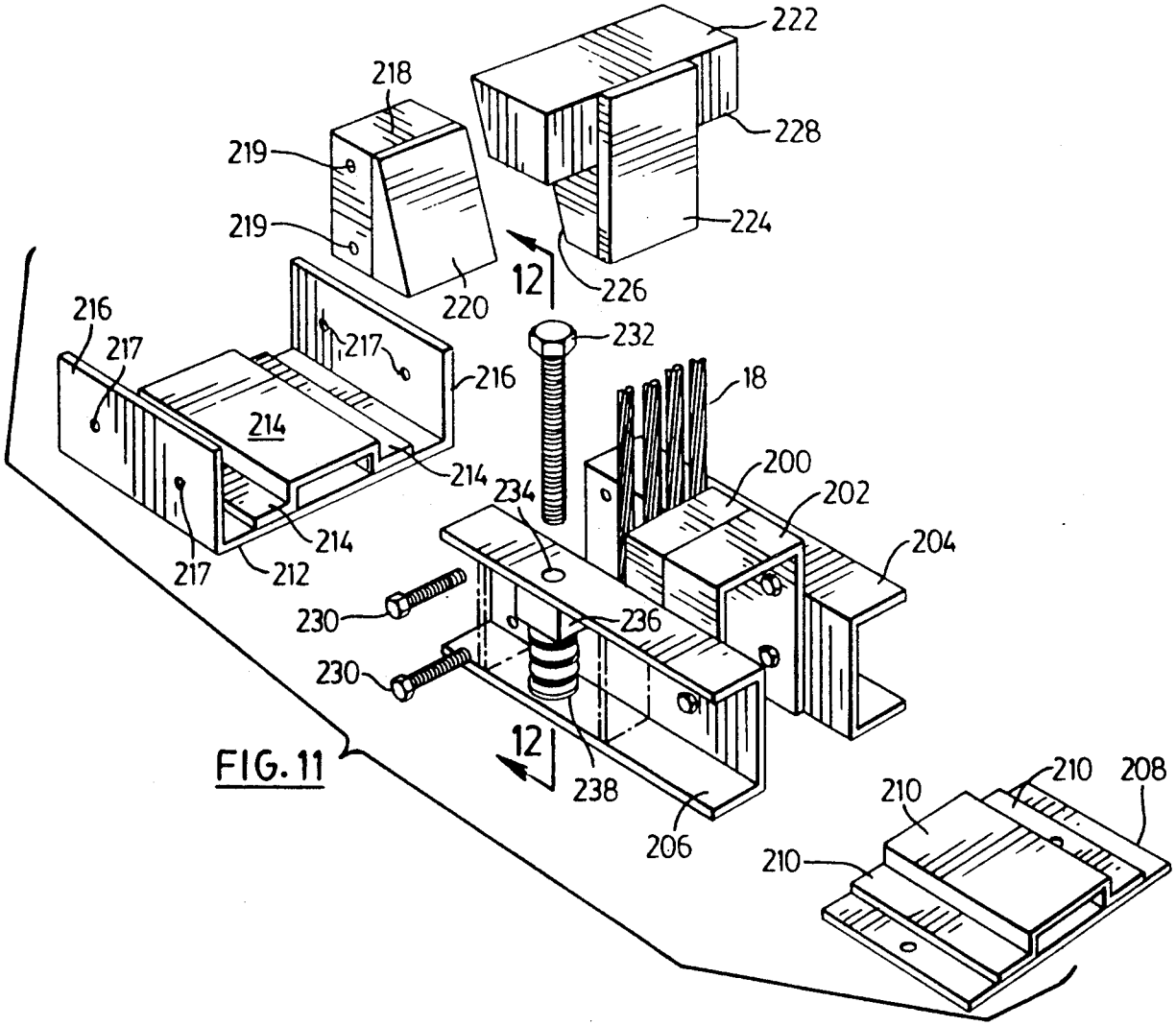
FIG. 11 is an exploded view of a second embodiment of the instant invention.

FIG. 11 shows an alternate embodiment of the present invention. In this alternate embodiment, the components comprise a first brake 200 which is secured to a back plate 202. A pair of channels 204 and 206 retain the back plate 202 in place. A base plate 208 is provided with teflon surfaces 210. It is intended that the channels 206 and 204 sit on the teflon coated surfaces 210.

At the other end is shown a second base plate 212 again with teflon surfaces 214. The side flanges 216 contain mounting holes 217 for a trip mechanism such as trip mechanism 38 previously described. A wedge base 218 is shown with a teflon coated wedge surface 220. An internal spring, not shown, would allow the wedge surface 220 to slide axially with respect to the base 218. A second brake 222 includes a brake surface 224 and a wedge shaped rear surface 226 which slides upon teflon surface 220. T-shaped arms 228 are also shown on the second brake 222. The wedge base 218 includes a pair of mounting apertures 219 through which bolts 230 would be inserted. This would lock the wedge base 218 securely into the channels 204, 206.

Also shown is a bolt 232 which fits into an aperture 234 in channel 206. Although only one bolt 232 is shown it would be appreciated that an identical bolt and structure would be located on the opposite side, in channel member 204. Also shown in FIG. 11 is a nut 236 and a plurality of spring washers 238.

Figure 12:
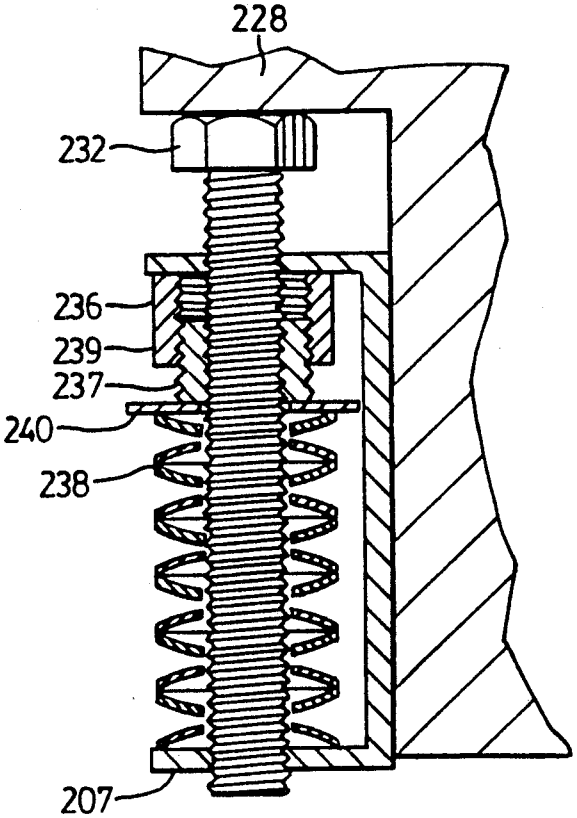
FIG. 12 is a close up of a portion of FIG. 11.

Turning to FIG. 12, an enlarged view of the bolt 232 is shown. The nut 236 includes an inner portion 237 and an outer portion 239. The inner portion 237 interacts with a plate 240 which in turn interacts with the spring washers 238. The other end of the spring washers 238 is restrained by a lower limb 207 of channel 206. The outwardly extending T-shaped arm 228 of the second brake 222 is shown in broken outline. It can be now appreciated that as the second brake 222 engages the cables 18 and is driven downwardly, the outwardly extending arm 228 will engage the upper surface of bolt 232. Bolt 232 is capable of moving vertically, but as vertical movement is incurred compression of the disc washer springs 238 will occur. This will have a slowing effect on the amount of gripping pressure applied to the cables 18 and will prevent the brake mechanism disclosed in FIGS. 11 and 12 from being applied too quickly causing a jerk to the elevator cab. It will be appreciated by those skilled in the art that while a different configuration of sliding members is shown in the embodiment of FIGS. 11 and 12, the operation of the brake mechanism is identical to that of the previously described embodiment. Further, the use of the bolt 232 as an additional means to gradually apply braking pressure to the cables 18 could easily be incorporated into the embodiment of FIG. 1 to 10. In general, this bolt 232, in combination with the spring washers 238 can be considered as a spring loaded stop, or limit for the downward movement of second brake block 46 or 222.

It can now be appreciated how the present invention operates. There are several alternate modes of tripping this elevator brake safety device 10. The first mode is in the event of an unsafe overspeed operation. In an overspeed situation the elevator car may be descending so rapidly as to create a dangerous situation. In this event, the pivoting dogs 154 and 156 will extend outwardly, will catch the trip lever 114 which in turn will cause the second brake block 46 to be released. This will cause the frictional surfaces 60, 62 to engage the brake cables 18 as previously described. Note that this trip mechanism is completely mechanical and will operate even in the absence of electrical power or if the electrical power is on and holds either the brake of the elevator motor, or the solenoids in the open position.

The second trip situation is in the event that there is a power failure and the elevator begins to move due to a situation such as the brake being stuck open or a broken shaft or gearbox, or, in the event that the elevator begins to move when the elevator doors are still partially open. In the event that there is no power to the solenoids 142, the plungers 144 will be in an extended position so that the plungers 144 will be contacted by the fixed lugs 140. When the elevator doors are open, a relay switch will cut the power to the solenoids whereby the plungers 144 will also be in the extended position. Of course, in the event of a power failure the plungers will assume the extended position where they can be tripped by the lugs 140 upon a small rotation of the governor 100. The lugs 140 can be placed at any convenient spacing, although it is preferable if the mechanism was tripped within a few inches of movement of the elevator cable 18. Someone skilled in the art will also understand that the lugs 140 would not be necessary if the solenoid 142 had a sufficiently strong spring 143 that the force of friction between the plunger 144 and the wheel 100 was adequate to trip the lever 114 and would further realize that a similar trip mechanism could be easily adapted to be added to existing governors so that the existing governors might be able to trip the existing elevator safety at the bottom of the car thus allowing the use of the instant brake mechanism 39 on the counterweight side only.

As the trip lever 114 is rotated about pivot point 122, the release lever 132 is pulled out of the back of the second brake block 46. This allows second brake block 46 to slide downwardly under the influence of gravity and into engagement with the elevator cables 18. Then, the self centering action of the brake mechanism previously described is able to effectively stop the brake cables 18 preventing an accident from occurring.

From the foregoing, it will be appreciated that the embodiment previously described preferably acts to stop elevator cables moving downwardly past the braking device. Thus, in certain circumstances it may be desirable to place a separate mechanism on either side of the traction sheave of the elevator whereby braking can be effected for either the elevator car or the counterweight. This is shown in FIG. 1A. However, in some circumstances it may not be economical to duplicate the mechanism and install on both the elevator car side and on the counterweight side of the cables. However, the device previously described can be modified to act on the cable in both an up and a down direction.

FIG. 13 discloses a further embodiment of the instant invention which is capable of braking in both the up and the down direction. In FIG. 13, like numerals are used to indicate like components with the addition of a prime. In addition, the trip mechanism 38' is shown only in sketch outline for the purposes of illustration.

Figure 13A:
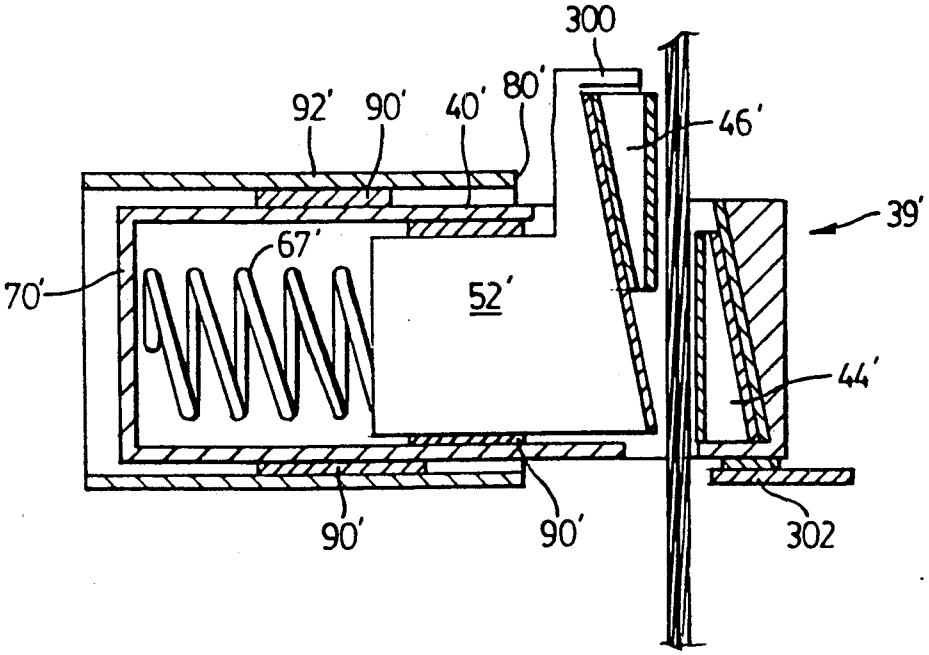
FIG. 13A is a side view of a further embodiment.

As shown in FIG. 13A, the first housing 40' includes a sled 52' and is housed within a second housing 92'. A spring 67' acts between the rear wall 70' of the first housing 40' and the sled 52'. Teflon strips 90' are located between the sled 52' and the first and second housings 40' and 92' respectively. Also shown is first brake 44' and second brake block 46'. It will be noted from FIG. 13A that while 46' is wedge shaped as in the first embodiment, 44' is additionally wedge shaped, unlike in the first embodiment where 44' was simply a flat brake pad.

Also shown are an upper lip 300 and a lower lip 302. The upper lip 300 is located in the sled 52' and is to prevent second brake block 46' from moving above a predetermined position relative to sled 52'. Similarly, lower lip 302 is to prevent the first brake 44' from moving below a predetermined position relative to the first housing 40'.

Moving now to FIG. 13B, the operation of the brake mechanism 39' can now be described. Shown in illustrative outline is a governor 99'. The governor 99' contains fixed lugs 140' which act on a trip lever 114' Unlike in the first embodiment, however, the trip lever 114' is tripped clockwise in the direction of arrow 304. The untripped position is shown in ghost outline as 305.

As the lever 114' is tripped, it pivots about pivot point 130'. This has the effect of drawing a connector element 306, in the direction of arrow 308. This releases a pivoter indicated generally at 310. Attached at one end of the pivoter is a counterweight 312. It will be appreciated by those skilled in the art that the counterweight 312 could be replaced by for example a spring which urges the end 311 of the pivoter 310 downwardly. This in turn causes the pivoter 310 to pivot about pivot point 314 in the direction of arrow 316. In turn this causes lever arm 318 to exert a force on the first brake block 44' in the direction of arrow 320. As first brake block 44' engages cables 18' which are moving in the direction of arrow 322, first brake block 44' is driven further in the direction of arrow 320. This causes the cables to be clamped between surfaces 60' and 62' of first and second brake blocks 44' and 46' respectively. The sled 52' being spring loaded as shown in FIG. 13A operates in an identical manner to that previously described.

Figure 13C:
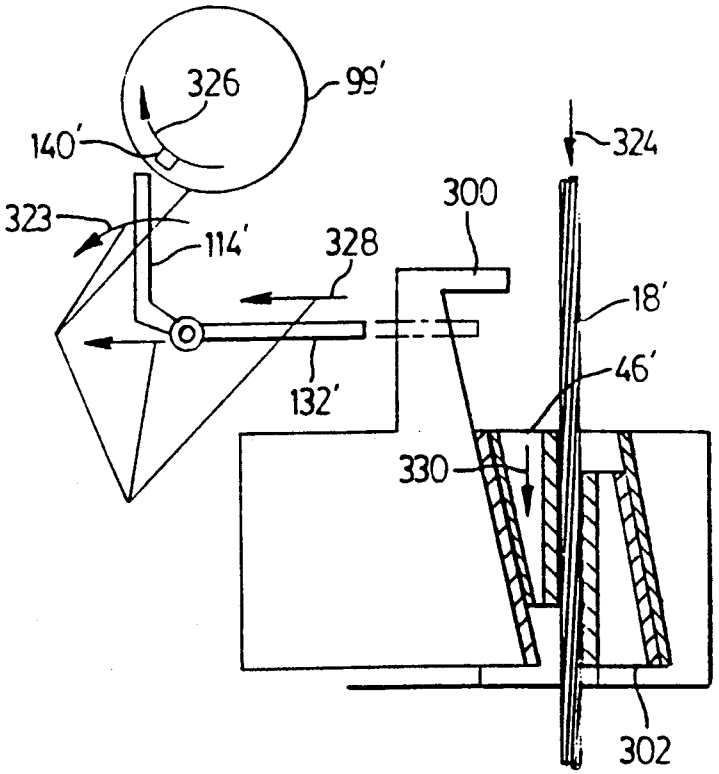
FIG. 13C is the embodiment of FIG. 13A in a down tripped position.
Figure 13B:
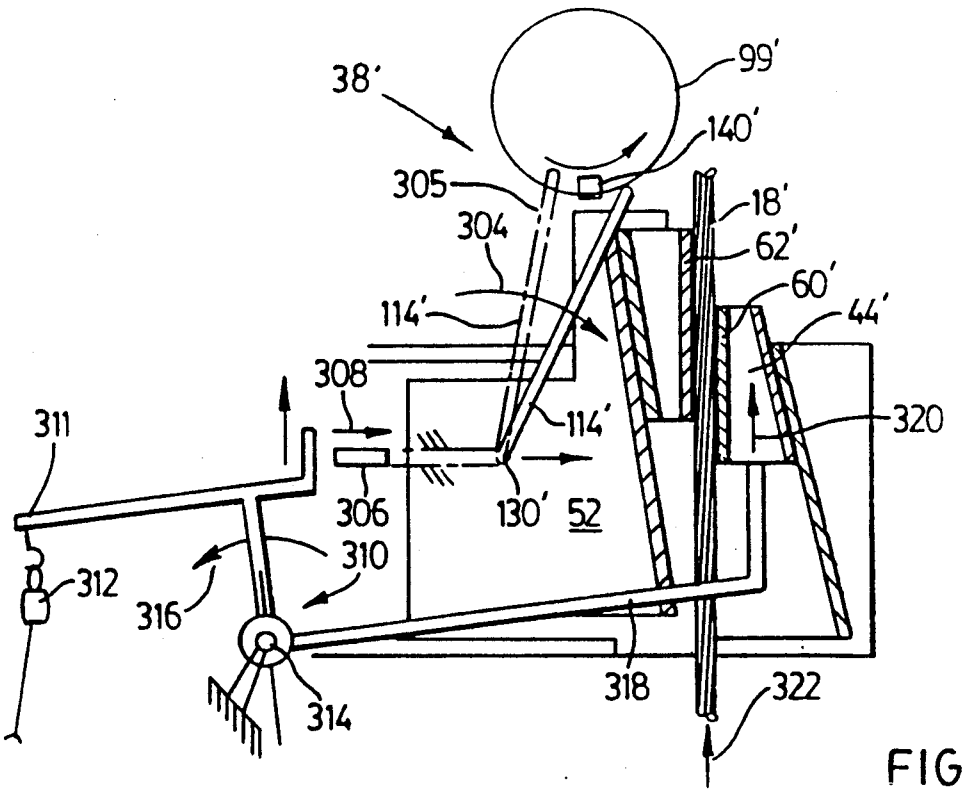
FIG. 13B is the embodiment of FIG. 13A in an up tripped position.

Turning now to FIG. 13C, the operation of the embodiment of FIG. 13A in the downward direction can be seen. In this case, the direction of the cables is indicated by arrow 324. Again, the governor 99' includes a number of fixed lugs 140'. In this case the governor 99' is rotating in the direction of arrow 326. As the lugs 140' engage a trip lever 114', trip lever 114' is tripped in the direction of arrow 323. This in turn draws a release lever 132' in the direction of arrow 328. This releases the second block 46' which in turn is allowed to fall under the influence of gravity in the direction of arrow 330. The braking of the cables 18' is then effected in the manner previously described for the other embodiments.

It will be appreciated from the foregoing description that the device as described above is capable of braking in either the up or down directions. Of course, in order to adequately restrain device if braking in the up direction, it will be necessary to securely retain the device against the machine room floor by heavy bolts reinforcements and the like. Such bracing of course must take into consideration the requirement that the device remain self centering and that the first housing be able to slide relative to the second housing as previously described.

It will be appreciated that the embodiments described above allow this safety mechanism to be installed easily and simply around existing elevator cables without the need of special modification of the motor or sheave housings of the elevator installations.

It will be appreciated by those skilled in the art that the foregoing description relates to preferred embodiments and that other modifications are possible within the broad scope of the appended claims. Some modifications have been discussed above and other will be apparent to those skilled in the art. For example, it is possible to further modify the braking effect of the brake mechanism 39 by including spring loaded limit stops in the form of bolts 232.

We claim:

1. A safety braking device for use on elevator cables, said device comprising:

a first housing slidably mounted in a second housing and having an opening through which said elevator cables can pass a first brake pad carried by said first housing on one side of said opening a second generally wedge shaped brake pad mounted in said first housing generally opposite said first brake pad on the opposite side of said opening and being moveable between a free-running position and a braking position; and means for releasing said second brake pad from said free-running position;

in use said first and second brake pads frictionally engaging and stopping said elevator cables upon said second brake pad being released by said release means, said first housing sliding within said second housing to keep said brake pads aligned around said cables during said stopping of said cables.

2. The elevator cable safety brake of claim 1 further including a moveable sled within said first housing, said sled carrying said second brake pad, and a biaser for urging said sled and said second brake pad toward said opening.

3. The elevator cable safety brake of claim 2 wherein said biaser is mounted between said sled and said first housing and as said second brake pad frictionally engages said cables and is driven by said cables, said sled is displaced away from said cables against said biaser, which urges said sled and said second brake pad back onto one side of said cables, and by means of said sliding first housing said first brake pad onto the other side of said cables.

4. The elevator cable safety brake of claim 2 wherein said free-running position is a raised position, and when said release means releases said second wedge shaped brake pad, said second brake pad is initially urged by gravity, a spring, or a counterweight, into frictional contact with said cable.

5. The elevator cable safety brake of claims 1, 2 or 3 further including low friction material between said second brake pad and said sled, between said sled and said first housing and said first housing and said second housing.

6. The elevator cable safety brake of claims 1, 2 or 3 wherein at least one side of said opening is removable and said device may be retrofit around an existing elevator cable installation by removing said removable side, placing said device in position with said cable between said brake pads and replacing said removable side.

7. The elevator cable safety brake of claims 1, 2 or 3 further including a second brake pad travel stop to limit the degree of movement of said second brake pad during braking.

8. The elevator cable safety brake of claims 1 2, or 3 further including a second brake pad travel stop to the limit the degree of movement of said second brake pad during braking, and a biaser to resiliently cushion said travel stop.

9. The elevator cable safety brake as claimed in claim 1 wherein said release means comprises a trip mechanism activated by a governor driven by said elevator cables.

10. The elevator cable safety brake device as claimed in claim 9 wherein said release means comprises a trip lever, connected to a release lever, said release . lever releasably holding said second brake in said free running position, and a means for tripping said trip lever from a normal position to a tripped position, thereby disengaging said release lever from said second brake.

11. The elevator cable safety brake of claim 10 wherein said means for tripping said trip lever comprises at least one outwardly rotatable dog carried by said governor, which, upon being rotated above a predetermined speed, rotates outwardly to trip said trip lever.

12. The elevator cable safety brake of claim 11 wherein said outward rotation of said dog is restrained by an adjustable tension spring.

13. The elevator cable safety brake of claim 11 wherein said rotatable dog is carried under a cover plate having first lugs, and in an overspeed condition said dog contacts said lugs thereby tripping said trip lever.

14. The elevator cable safety brake of claim 10 wherein said means for tripping comprises at least one fixed second lug mounted to said governor, and a solenoid actuated plunger mounted on said trip lever, wherein said plunger, in the trip position, contacts said fixed second lug thereby tripping said trip lever.

15. The elevator cable safety brake of claim 10 wherein said means for tripping comprises a solenoid actuated plunger mounted between said trip lever and said governor wherein said plunger in the trip position extends contact between the governor wheel and trip lever with sufficient force that as the governor turns, the trip lever is tripped.

16. The elevator cable safety brake of claims 14 or 15 wherein said solenoids are electrically connected in series with doors on a respective elevator car, wherein electrical power to said solenoids is switched off when said doors are opened to allow loading and unloading of passengers.

17. The elevator cable safety brake of claims 13, 14 or 15 wherein an over tip spring is provided for said trip lever to urge said trip lever into the tripped position upon said trip level being displaced from said normal position.

18. The elevator cable safety brake as claimed in claim I wherein both said first and said second brake pads are generally wedge shaped, and said sled includes an upper stop lip for said second brake pad and said first housing includes a lower stop lip for said first brake pad.

19. The elevator cable safety brake as claimed in claim 18 further including a governor driven by said elevator cables and a means for releasing said second brake pad, and a means for urging said first brake pad, said second brake pad, upon being released, being moved by gravity into frictional engagement with said cables, and said first brake pad upon being urged, frictionally engaging said elevator cables.

20. The elevator cable safety brake as claimed in claim 19 wherein said means for urging comprises a spring, a counterweight, or both.

* * * * *